US010442225B2

(12) United States Patent
Costal et al.

(10) Patent No.: US 10,442,225 B2
(45) Date of Patent: Oct. 15, 2019

(54) WIPER ROLL TO CAUSE FRICTION ON A PRINT MEDIUM

(71) Applicant: Hewlett-Packard Development Company, L.P., Houston, TX (US)

(72) Inventors: Pau Costal, Sant Cugat del Valles (ES); Carles Flotats Villagrasa, Sant Cugat del Valles (ES); Antonio Gracia Verdugo, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/097,885

(22) PCT Filed: Jul. 28, 2016

(86) PCT No.: PCT/US2016/044519

§ 371 (c)(1),
(2) Date: Oct. 31, 2018

(87) PCT Pub. No.: WO2018/022067

PCT Pub. Date: Feb. 1, 2018

(65) Prior Publication Data

US 2019/0092060 A1 Mar. 28, 2019

(51) Int. Cl.

| | |
|---|---|
| ***B41J 29/17*** | (2006.01) |
| ***B41J 11/00*** | (2006.01) |
| ***B41J 15/04*** | (2006.01) |

(52) U.S. Cl.

CPC ..... *B41J 29/17* (2013.01); *B41J 11/0015* (2013.01); *B41J 15/04* (2013.01)

(58) Field of Classification Search

CPC ..... B41J 29/17; B41J 11/0015; B41J 15/04

USPC ..... 347/101, 104

See application file for complete search history.

(56) References Cited

U.S. PATENT DOCUMENTS

| | | | |
|---|---|---|---|
| 4,424,744 | A | 1/1984 | Harper et al. |
| 5,033,731 | A | 7/1991 | Looney |
| 6,834,930 | B2 | 12/2004 | Steinfield et al. |
| 8,783,686 | B2 | 7/2014 | Mackey et al. |
| 2011/0236116 | A1 | 9/2011 | Inoue |

(Continued)

FOREIGN PATENT DOCUMENTS

| | | |
|---|---|---|
| JP | 61064478 | 4/1986 |
| JP | H05139004 A | 6/1993 |

(Continued)

OTHER PUBLICATIONS

Unknown, EPSON SureColore® S30670 S50670 S70670 User's Guide, EPSON Exceed Your Vision, Aug. 2013, 193 pages.

*Primary Examiner* — An H Do

(74) *Attorney, Agent, or Firm* — HP Inc. Patent Department

(57) ABSTRACT

A device (2) includes a media roll (4) to output a print medium (M) in a forward direction (26) and a wiper roll (6) to contact the surface of the print medium (M) at a rotation speed to cause friction on the print medium (M). The device (2) may determine a radius (r2) of the media roll (4) outputting the print medium (M) and, based on this radius (r2), adapt parameters such as the rotation speed of the wiper roll and a back tension (T2) exerted by the media roll (4) on the print medium (M) so as to control the friction caused by the wiper roll (6) on the print medium (M).

14 Claims, 3 Drawing Sheets

(56) References Cited

U.S. PATENT DOCUMENTS

| | | | | |
|---|---|---|---|---|
| 2011/0268489 | A1 | 11/2011 | Azar et al. | |
| 2012/0212560 | A1 | 8/2012 | Paoletti et al. | |
| 2014/0204163 | A1 | 7/2014 | Ortiz et al. | |
| 2018/0104970 | A1* | 4/2018 | Jorba Closa | B41J 29/17 |
| 2019/0047285 | A1* | 2/2019 | Sakai | B41J 2/135 |

FOREIGN PATENT DOCUMENTS

| | | | |
|---|---|---|---|
| JP | 2014069932 | | 4/2014 |
| RU | 2414353 | C1 | 3/2011 |
| WO | WO-2015044202 | A1 | 4/2015 |

* cited by examiner

WIPER ROLL TO CAUSE FRICTION ON A PRINT MEDIUM

BACKGROUND

Inkjet printers, thermal inkjet printers in particular, have come into widespread use in business and homes because of their low cost, high print quality, and colour printing capability.

In operation, drops of printing fluid are emitted onto the print medium such as paper or transparency film during a printing operation, in response to commands electronically transmitted to the printhead. These drops of printing fluid combine on the print media to form the text and images perceived by the human eye.

Media or substrates used to print large format products may be based on plastic such as PVC (Polyvinyl Chloride) or vinyl. To overcome the intrinsic rigidity of PVC or vinyl, some components known as "plasticizers" may be added into the composition of the substrate during the manufacturing processes in order to render the material more flexible and durable.

DRAWINGS

For simplicity and clarity of illustration, the same reference numerals will be used throughout the figures to refer to the same or like parts, unless indicated otherwise.

Figure 1:
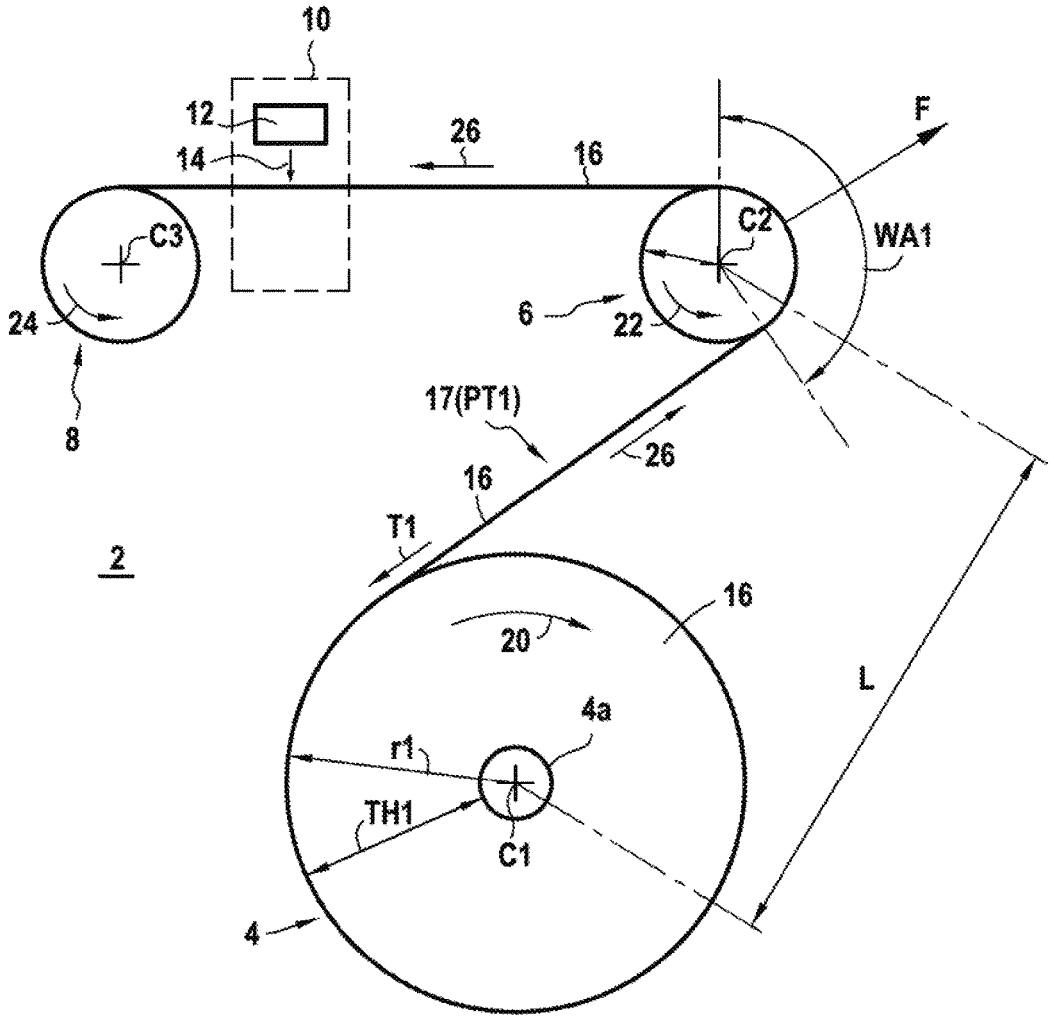
FIG. 1 is a cross-section view illustrating a system in a particular state, according to an example of the disclosure.

The components in the figures are not necessarily to scale, emphasis instead being placed upon illustrating the principles of the described subject matter.

DESCRIPTION

While the present disclosure is susceptible of implementation in many different forms, there are shown in the drawing and will be described herein in detail specific examples thereto with the understanding that the present disclosure is to be considered as an exemplification of the principles of the disclosure and is not intended to limit the disclosure to the specific implementations illustated.

Numerous details are set forth to provide an understanding of the implementations described herein. The examples herein may be practiced without these details. In other instances, well-known methods, procedures, and components have not been described in detail to avoid obscuring the implementations described.

As indicated above, some components known as "plasticizers" may be added into the composition of the PVC-based print media during manufacturing to render them more flexible and durable.

However, it has been observed that incorporating such plasticizers into a PVC-based or vinyl-based print medium (e.g. self-adhesive vinyl, PVC banners, etc.) may negatively affect the adhesion quality of printing fluid (ink or the like) over the surface of the print medium. As a result, plasticizers may substantially degrade the image quality of a printing on a PVC-based or vinyl-based print medium. Plasticizers may in particular cause image printing defects such as ink coalescence (i.e. ink tending to form aggregates resulting in that the ink does not cover properly the print medium), banding (because of differences in coalescence), bleed, marks, etc. Chemical components other than plasticizers may be present within a print medium and may also be the cause of such image quality defects.

These image quality defects induced by the presence of plasticizers (or the like) can be overcome by using a foam to rub the surface of the print substrate prior to printing. A continuous rubbing on the surface of the print substrate allows for a more even distribution of the plasticizers in the substrate and leads to an improvement of the substrate wettability.

It has been observed that the efficiency of this rubbing technique depends on the level of friction that is exerted on the surface of the print medium to evenly distribute the plasticizers (or the like) in a print medium. An aim of the present disclosure is to ensure that an appropriate level of friction (or friction effect) is applied on the surface of a print medium in order to address in an efficient manner the image quality issues mentioned earlier.

FIG. 1 shows a cross-section of a system 2 to cause friction on a print medium 16 in order to evenly distribute plasticizers or the like (not shown) present within the print medium 16 and which may cause image quality defects. The system 2 may be a printing apparatus such as an inkjet printer for instance.

As shown in FIG. 1, the system 2 includes a media roll (or input roll) 4, a wiper roll 66 and a drive roll 8.

More specifically, the media roll 4 incudes a cylindrical support roll 4*a* around which a medium sheet 16 is wrapped. The roll of print medium 16 together with the support roll 4*a* form the media roll 4.

The substrate or medium 16 which is considered in the present document may be any sort of sheet-like or web-based medium, including paper, cardboard, plastic and textile.

The print medium 16 may be made up of vinyl or PVC, for instance. As explained earlier, the print medium 16 may for instance include plasticizers for rendering the print medium 16 more flexible. These plasticizers may be for instance Phthalate components. In another example, chemical components other than plasticizers may be present in the composition of the print medium 16, these chemical components being susceptible to cause degradation of the image quality of printing as explained earlier with reference to plasticizers.

As shown in FIG. 1, the media roll 4 is rotatable about its longitudinal axis C1. By rotating the media roll 4 (in the rotation direction 20 in this example), the print medium 16 may be outputted in a forward direction 26 towards successively the wiper roll 6 and the driver roll 8. Moving the print medium 16 from the media roll 4 in the forward direction 26 is achieved under action of the drive roll 8 which rotates to pull the print medium print 16 forward.

In an initial state shown in FIG. 1, a thickness TH1 of print medium 16 is wrapped around the roll support 4*a*. The radius of the media roll 4 is noted r1 in this initial state. The thickness TH1, and thus the radius of the media roll 4, are bound to decrease as the print medium 16 is being pulled away from the media roll 4 in the forward direction 26 under the driving force of the drive roll 8.

The wiper roll 6 is positioned to rotate along its longitudinal axis C2 so as to cause function on the print medium 16 while the print medium 16 is conveyed in the forward direction 26 from the media roll 4 to 8 the printing area 10. In use, the wiper roll 6 rotates at a rotation speed (generally noted SP, wherein SP>0) in the rotation direction 22 as shown in FIG. 1, although other implementations are possible. As indicated later, the rotation speed SP of the wiper roll 6 may be controlled while the input medium 16 is being outputted from the media roll 4, this rotation speed being noted SP1 in the state shown in FIG. 1.

Part of the wiper roll circumference contacts the print medium 16. In use, the print medium 16 is partially wrapped around the wiper roll 6 while moving in the forward direction 26. The wrap angle—noted WA1 in FIG. 1 (and more generally WA)—defines the angular proportion of the wiper roll circumference which is in contact with the print medium 16 to cause friction thereon. This wrap angle may vary depending on the radius of the media roll 4 as explained below.

The surface of the print medium 16 may thus be rubbed using the rotating wiper roll 6. The rotation speed (generally noted SP) is controlled so that the wiper roll 6 rotates faster than the print medium 16 moving around the contacting portion of the wiper roll 6. Friction is caused by the normal force F exerted by the wiper roll 6 on the moving print medium 16 and by the speed difference between the surface of the wiper roll 6 and the opposite surface of the print medium 16 which is partially wrapped around the wiper roll 6.

The wiper roll 6 may be made up of any appropriate material or combination of materials to obtain the desired level of friction on the print medium 16. In the present example, the wiper roll 6 includes a foam, for instance in the form of an outer foam layer (not shown), that contacts the print medium 16 as it moves forward under the action of the drive roll 8. The characteristics of the foam may be chosen to provide an appropriate friction coefficient versus the print medium 16. The foam may have a friction coefficient versus print medium comprised between 0.3 and 0.7 (in the case for instance where the print medium 16 is made up of vinyl). Abrasive materials other that foam may however be used in other implementations. For instance, the wiper roll 6 may be made up of rubber depending on the friction effect that one wish to achieve.

Using foam as an abrasive surface of the wiper roll 6 may allow for small misalignments of the rotation axis C2 of the wiper roll 6 and may also provide an appropriate level of friction for a large range of medium types such as vinyl- or PVC-based substrates.

The foam of the wiper roll 6 may be compressible, to 50% of its thickness for instance. The foam of the wiper roll 6 is for instance in Polyurethane.

As indicated earlier, in use, the drive roll 8 is to rotate (in the rotation direction RT3 shown in FIG. 1) along its longitudinal axis C3 to move the print medium 16 from the media roll 4 along the print-medium advance direction 26. The drive roll 8 may be part of a medium advance mechanism including other components (not shown) including, for instance, rollers, a driving motor and/or any other appropriate components for the purpose of moving the print medium 16 along the forward direction 26.

In the present example, the system 2 also includes a printing device (or printing unit) 12, which include print heads to print printing fluid 14 (ink or the like) in a printing area 10 on the print medium 16. The system 2 is to control the drive roll 8 so as to adjust the relative position of the print medium 16 along the print-medium advance direction 26 in order to cause printing at the appropriate locations on the print medium 16.

As shown in FIG. 1, the media roll mays may exert, in use, a back tension—noted T1 in FIG. 1 (and more generally T)—on the print medium 16 in a backward direction (i.e. opposite to the direction 26 along which the print medium 16 is being outputted). This back tension T is controlled so as to apply a resistance to the driving action of the drive roll 8 along the forward direction 26. Exerting this back tension T allows for the print medium 16 to move in a straight configuration from the media roll 4 to the drive roll 8.

In the present example, the portion of print medium 16 extending from the media roll 4 to the wiper roll 6 is noted 17. This portion 17 is pulled straight under the combined action of the back tension T exerted by the media roll 4, the driving force applied by the drive roll 8 in the forward direction 26 and the normal force F applied therebetween by the wiper roll 6 on the surface of the print medium 16. The position of the portion 17 in the initial state shown in FIG. 1 is noted PT1. As indicated further below, the position of the portion 17 of the print medium 16 may vary depending on the current radius r of the media roll 4.

By controlling the rotation speed SP of the wiper roll 6 and the back tension T applied by the media roll 4 in the backward direction, the friction effect caused by the wiper roll 6 on the print medium 16 can be controlled. Wiping (or rubbing) the surface of the print medium 16 allows to evenly distribute plasticizers (or the like) on or within the print medium 16, thereby reducing or preventing occurrence of the image quality defects described earlier. As a result, a good quality of printing may be achieved, even in a case where plasticizers or the like are present in the composition of the print medium.

However, as explained further below, it has been observed that the level of friction achieved on the print medium 16 is also dependent upon the radius r of the media roll 4. As indicated earlier, the radius (noted r1 in the initial state shown in FIG. 1) of the media roll 4 may decrease while the print medium 16 is being outputted along the forward direction 26 under the driving action of the drive roll 8. It has been observed that a reduction of the radius r of the media roll 4 leads to a corresponding reduction of the wrap angle WA and a change of the normal force F applied by the wiper roll 6, thereby resulting in a reduction (and alteration) of the friction effect caused by the wiper roll 6 on the print medium 16. As a result of the variations in the degree of friction caused by the wiper roll 6, the plasticizers (or other components susceptible to cause image quality defects) present on or within the print medium 16 may not be evenly distributed within some parts of the print medium 16, especially about the end of the print medium 16 which is to be rubbed by the wiper roller 6 while the radius of the media roll 4 is very low (near exhaustion of the print medium M).

The present disclosure provides for a technique which allows for an efficient control of the friction effect caused by the wiper roll 6 on the print medium 16 despite the variations of the radius of the media roll 4, especially but not exclusively, due to the print medium 16 being outputted.

Figure 2:
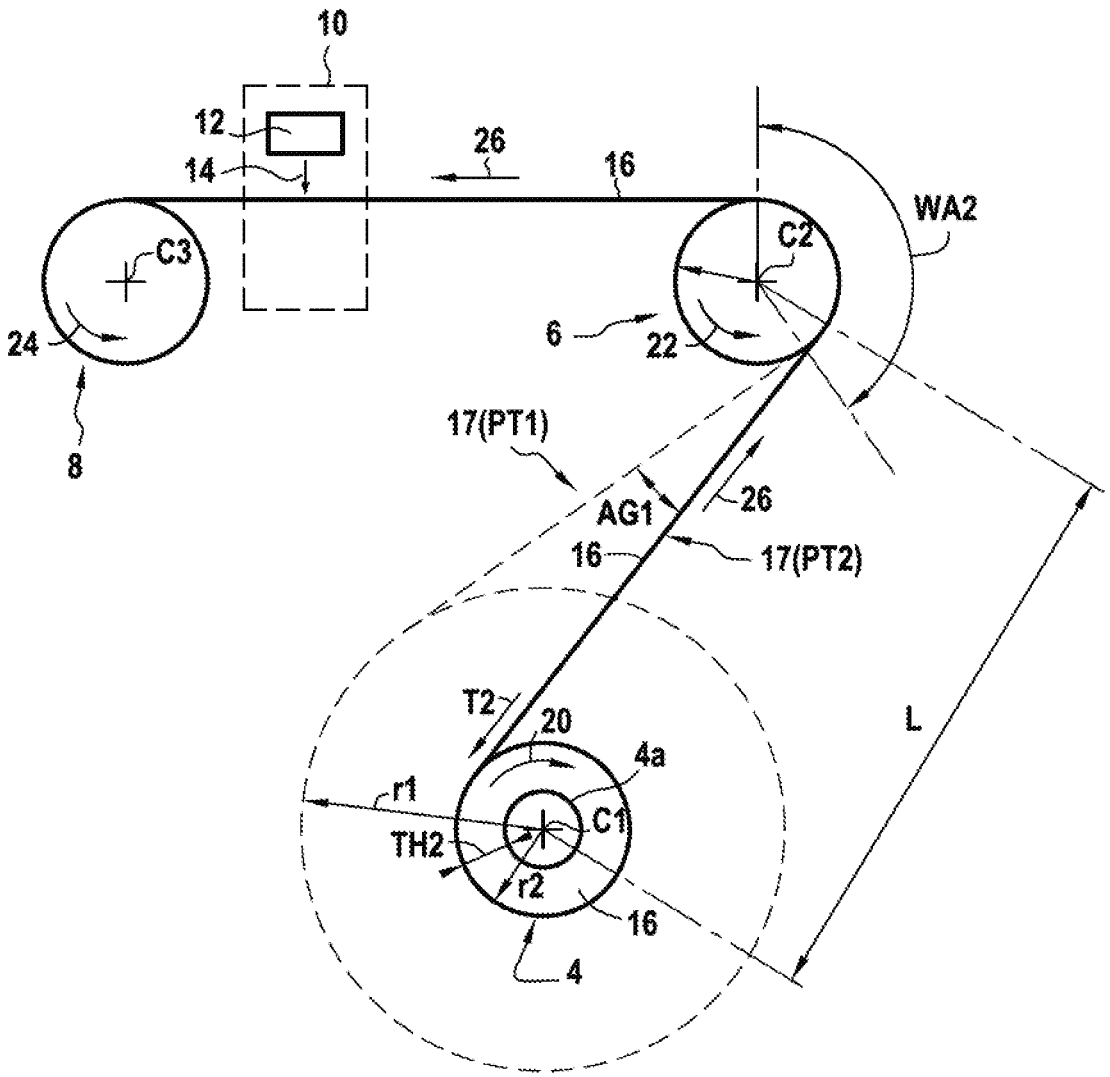
FIG. 2 is a cross-section view illustrating the system of figure a different state, according to an example of the disclosure.

FIG. 2 shows a cross-section of the same system 2 as represented in FIG. 1, but in a different (later) state. The system 2 depicted in FIG. 2 differs in that it is now assumed that part of the print medium 16 originally wrapped around the support roll 4*a* has left the media roll 4 and moved forward under the driving action of the drive roll 8. A thickness TH2, smaller than the original thickness TH1 shown in FIG. 1, of the print medium 16 remains around the support roll 4*a* of the media roll 4. In a particular example, TH2=0 which means that the print medium 16 on the media roll 4 has been exhausted.

As a result, the radius—noted r2 in the present state—of the media roll 4 is lower that the radius r1 of the media roll 4 in its initial state shown in FIG. 1. This decrease of the radius of the media roll 4 leads to an alteration of the position—noted PT2 in the present state—of the portion 17 of the print medium 16 extending from the media roll 4 to the wiper roll 6. This portion 17 of the print medium 16 is moved by an angle AG1 with respect to the portion 17 in its original position PT1 shown in FIG. 1. In other words, the angle AG1 is defined by the portion 17 of the print medium 16 in its original position PT1 and the same portion 17 in its later positon PT2.

The change in position from PT1 to PT2 of the print medium 16 between the media roll 4 and the wiper roll 6 leads to a reduction of the wrap angle—noted WA2 in the present state—defining the proportion of the wiper roll circumference contacting the print medium 16 to cause friction thereon. Since WA2<WA1, the wiper roll 6 causes friction on a smaller area of the print medium 16 at any given time. As a result, the friction effect achieved by the wiper roller 6 tends to decrease.

According to a particular example of the present disclosure, the rotation speed SP of the wiper roll 6 or the back tension T exerted by the media roll 4 on the print medium 16 may be adapted, based on the radius r of the media roll 4, as to control the friction caused by the rotating wiper roll 6 on the print medium 16. By adapting the rotation speed SP or the back tension T, it is possible to compensate for the decrease of the radius of the media roll 4 while the print medium 16 is being outputted, thereby maintaining an appropriate friction effect by the wiper roll 6 throughout the length of the print medium 16.

Figure 3:
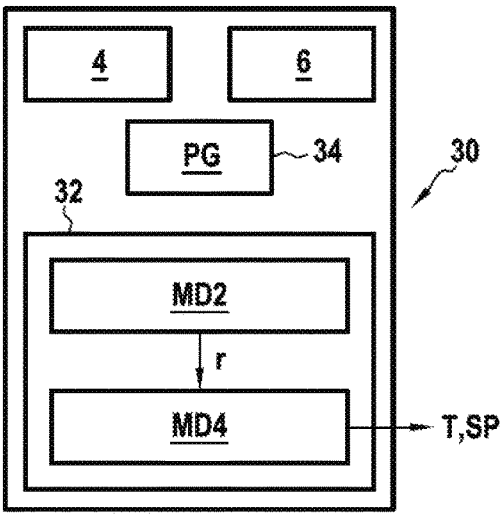
FIG. 3 is a block diagram showing a control device according to an example of the disclosure.

FIG. 3 is a schematic block diagram shoving a control device 30 according to a particular example of the present disclosure. The device 30 includes the media roll 4 and the wiper roll 6 of the system 2 as described above, along with a controller 32 (e.g., a processor) and a non-volatile memory 34.

The device 30 may also include the drive roll 8 of the system 2, and more generally any component of a medium advance mechanism which the drive roll 8 may be part of. As indicated earlier, the media roll 4 is to output, by rotation about its rotation axis C1, the print medium 16 in a forward direction 26.

In the present example, the non-volatile memory 34 stores a computer program PG according to a particular example, this computer program PG including instructions for carrying out a method according to a particular example. Example implementations of this method will be described later with reference to FIGS. 4-5. The memory 34 constitutes a recording medium according to a particular example, readable by the controller 32.

The computer program PG can be expressed in any programming language, and can be in the form of source code, object code, or any intermediary code between source code and object code, such that in a partially-compiled form, for instance, or in any other appropriate form.

In addition, the recording medium 6 can be any entity or device capable of storing the computer program PG. For example, the recording medium can comprise a storing means, such as a ROM memory (a CD-ROM or a ROM implemented in a microelectronic circuit), or a magnetic storing means such as a floppy disk or a hard disk for instance.

Moreover, the recording medium 6 can correspond to a transmittable medium, such as an electrical or an optical signal, which can be conveyed via an electric or an optic cable, or by radio or any other appropriate means. The computer program according to the disclosure can in particular be downloaded from the Internet or a network of the like.

In the present example, when running the computer program PG, the controller 32 implements a radius determining module MD2 and a setting module MD4, as depicted in FIG. 3.

The radius determining module MD2 is to determine a radius r of the media roll 4. As will be explained later, different techniques may be used by device 30 to determine the current radius of the media roll 4.

The setting module MD4 is to adapt, based on the radius r determined by the radius determining module MD2, the rotation speed SP of the wiper roll 6 or the back tension T exerted by the media roll 4 on the print medium 16 so as to control the friction caused by the wiper roll 6 on the print medium 16.

The modules MD2 and MD4 constitute a non-limitative example of implementation. The configuration of the modules MD2 and MD4 is more apparent in view of the example implementations described below.

The controller 32 may also control rotation of the drive roll 8. The controller may in particular control the advancing speed and driving force at which the print medium 16 is moved along the forward direction 16 or the driving force applied by the drive roll 8 on the print medium 16. In a particular example, the controller 32 is a processor of the system 2.

Figure 4:
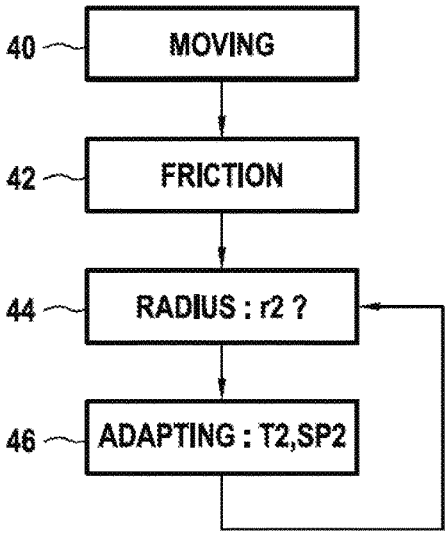
FIG. 4 illustrates a flow chart of an example of a method of the present disclosure.

FIG. 4 is a flow diagram showing a method according to a particular example of the present disclosure. The device 30 depicted in FIG. 3 operates within the system 2 represented in FIGS. 1 and 2 to implement the method of FIG. 4.

More specifically, it is now assumed that the system 2 is in the initial (or reference) state illustrated in FIG. 1 and that the print medium moves (40) in the forward direction 26 from the rotating media roll 4 outputting the print medium 16. As described earlier, advancement of the print medium 16 is achieved in the present example by the combination of the driving force applied by the drive roll 8 in the forward direction 26 and the back tension T1 applied by the media roll 4 in the opposite direction.

While the print medium 16 is being moved (40) forward, friction is caused (42) on the print medium 16 using the rotating wiper roll 6. For such a friction to be achieved, the wiper roll 6 contacts the surface of the print medium 16 at an initial rotation speed SP1 (>0) while the initial back tension T1 is exerted by the media roll 4 on the print medium 16.

In 44, the device 30 determines the radius r of the media roll 4. More specifically, in the present example, after a given time of moving (40) the medium print 16 forward while causing friction (42) thereon, the system 2 reaches the current state depicted in FIG. 2. As a result, the device 30 determines the radius r2 of the media roll 4 in 44. As already indicated, different techniques may be used by the device 30 to determine the current radius r2 of the media roll 4.

The radius determination 44 may be performed while the media roll 4 is rotating or at a time when the media roll does not rotate.

The device 30 then sets or adapts (46), based on the radius r2 of the media roll 4 determined in 44, the rotation speed—noted SP2—of the wiper roll 6 or the back tension—noted T2—exerted by the media roll 4 on the print medium 16 so as to control the friction caused by the rotating wiper roll 6 on the print medium 16.

In a particular example, the device 30 adapts in 46 the rotation speed SP2 of the wiper roll 6 or the back tension T2 exerted by the media roll 4 so as to compensate, in the state illustrated in FIG. 2, for a decrease of the friction effect (or degree of friction) exerted by the wiper roll 6 onto the print medium 16 due to a decrease of the radius r of the media roll 4 from the initial radius 11 (as shown in FIG. 1) to the current radius r2 (as shown in FIG. 2).

The adapting 46 may comprise increasing the rotation speed of the wiper roll 6 or the back tension exerted by the media roll 4 on the print medium 16. Increasing the rotation speed SP2 (relative to the initial speed SP1) or the back tension T2 (relative to the initial back tension T1) allows to compensate for a decrease of the friction effect by the wiper roll 6 due to a decrease of the radius of the media roll 4 from the initial radius r1 (FIG. 1) to the radius r2 (FIG. 2).

The present disclosure allows to maintain at an appropriate level the friction caused by the wiper roll 6 despite any variation of the radius of the media roll 4, such as a decrease of this radius due to the output of a certain amount of the print medium 16 from the media roll 4 or an increase of this radius due to the input of a certain amount of the print medium 16 to the media roll 4. By controlling the friction generated by the wiper roll 6, any plasticizer or the like present on or within the print medium 16 can be evenly distributed, thereby avoiding or limiting occurrence of image quality defects as explained earlier.

In a particular example, the device 30 adapts in 46 the rotation speed SP2 but not the back tension T2. In another example, the device 30 adapts in 46 the back tension T2 but not the rotation speed SP2. The device 30 may adapt (46) both the rotation speed SP2 and the back tension T2. In a particular example, the device 30 may allocate in 46 a respective weight to the adaptation of each of these two parameters into compensating for a decrease in the radius of the media roll 4 from r1 (FIG. 1) to r2 (FIG. 2).

In a particular example, the device 30 adapts in 46 the rotation speed SP2 of the wiper roll 6 or the back tension T2 exerted by the media roll 4 on the print medium 16 so as to maintain constant the friction effect exerted by the wiper roll 6 onto the print medium 16 while the radius r of the media roll 4 decreases (from r1 to r2).

In a particular example, the device 30 repeats the determination 44 and the adaptation 46 to maintain constant over time the friction effect exerted by the wiper roll onto the print medium.

In a particular example, while the system 2 is in the current state illustrated in FIG. 2, the setting module MD4 adapts the rotation speed SP2 of the wiper roll 6 and the back tension T2 exerted by the media roll 4 on the print medium 16 based on the following equations:

$$VSP2=C\cdot SP1\cdot(WA1/(WA1-A)-1) \quad \text{EQ1:}$$

$$VT2=(1-C)\cdot T1\cdot(\cos(WA1-A/2)/\cos(WA1/2)-1) \quad \text{EQ2:}$$

$$A=\sin^{31\ 1}((r1-r2)/L) \quad \text{EQ3:}$$

where:

SP1 is the initial rotation speed of the wiper roll 6 at the initial state illustrated in FIG. 1, used as a reference rotation speed;

VSP2 is the variation applied to the rotation speed SP2 relative to the initial rotation speed SP1 (VSP2=SP2−SP1);

WA1 is the initial wrap angle illustrated in FIG. 1, used as reference wrap angle;

C is a weight allocated to the rotation speed of the wiper roll 6 in the adapting 46 (C being comprised between 0 and 1);

VT2 is the variation applied to the back tension T2 relative to e initial back tension T1 (VT2=T2−T1);

r1 is the initial radius of the media roll 4 in the state shown in FIG. 1, used as a reference media roll radius;

r2 is the radius of the media roll 4 in the current state shown in FIG. 2;

L is the distance between the rotation axis C1 and C2 of the media roll 4 and the wiper roll 6 respectively.

In the present example, the parameters SP1, WA1 and r1 are known constant values used as a reference values. The distance L is defined by the geometry of the system 2 and is also a known constant. The value of the weight C is set between 0 and 1 depending on the weight that is allocated to adapting the rotation speed of the wiper roll 6 and the back tension of the media roll 4.

In a particular example, the media roll 4 shown in FIG. 1 is a new (or virgin) input roll. Other implementations are however possible. More particularly, any intermediate depletion state of the media roll 4 (e.g. half depleted or 100% depleted) may be used as a reference state for determining SP2 and T2 using the above equations EQ1-EQ3. In some cases, the variations VSPD2 and VT2 may be negative.

Equation EQ1 may equally be expressed as follows:

$$SP2=C\cdot SP1\cdot(WA1/(WA1-A)) \quad \text{EQ1':}$$

Equation EQ2 may equally be expressed as follows:

$$T2=(1-C)\cdot T1(\cos(WA1-A/2)/\cos(WA1/2)) \quad \text{EQ2':}$$

where A is obtained based on equation EQ3 as defined above.

In a particular example, the following values are being considered: L=216 mm (millimeters); r1=137.5 mm; r2=30 mm; and WA1=119 degrees. In that particular example, the parameter A (defined by the above equation EQ3) ranges between 0 (for the reference state of FIG. 1) to 32 degrees (in the case where the media roll 4 is exhausted, that is when TH2=0). Still in that example, the reference rotation speed SP1 equals to 30 rpm (revolution per minute) and the reference back tension T1 equals to 15 N (Newton) per meter of width of the medium 16 (e.g., a roll of print medium 16 which is 1 meter wide or 2 meter wide will receive respectively a back tension of 15 Newton or 30 Newton). It is now assumed that the media roll 4 is consumed and reaches the end (thickness TH2=0; A=32 degrees). Using the above equations EQ1 (or EQ1'), EQ2 (or EQ2') and EQ3, and considering an equal distribution of the compensation for the rotation speed SP2 of the wiper roll 6 and for the back tension T2 exerted by the media roll 4 (i.e. C=0.5), the device 30 would increase (46) the rotation speed SP2 of 5.5 rpm relative to SP1 (SP2=30 5.5=35.5 rpm) and increase (46) the back tension T2 of 3 N per linear meter relative to T1 (T2=15+3=18 N per linear meter). As a result, the friction effect generated by the wiper roll 6 on the surface of the print medium 16 can be maintained substantially constant.

In a particular example, C=1 such that the rotation speed SP2 of the wiper roll 6 is modified in 46, as shown in FIG. 4. The equation EQ1 may thus read as follows:

$$VSP2=SP1\cdot(WA1/WA1-A)-1) \quad \text{EQ1 (with C=1):}$$

In a particular example, C=0 such that the back tension T2 exerted by the media roll 4 is modified in 46, as shown in FIG. 4. The equation EQ2 may thus read as follows:

$$VT2=T1\cdot(\cos(WA1-A/2)/\cos(WA1/2)-1) \quad \text{EQ2 (with C=0):}$$

Furthermore, the friction effect caused by the wiper roll 6 on the print medium 16 can be quantified in a friction force multiplied by time (N.s for "Newton.second"). In a particular example, the device 30 adapts (46), based on the radius r2 determined in 44, the rotation speed SP2 of the wiper roll 6 or the back tension T2 exerted by the media roll 4 so that the friction force exerted by the wiper roll 6 is at least 5 N.s, or at least 6 N.s, or at least 7 N.s.

In a particular example, still with reference to FIGS. 1-4, a method implemented by the device 30 includes: conveying (40) the print medium 16 in the forward direction 26 from the rotating media roll 4 from which the print medium 16 is being output; applying (42) the wiper roll (6) onto the print medium 16, while the wiper roll 4 is rotating at a rotation speed (>0), to cause friction on the print medium M; and adapting (46), based on the radius r2 of the media roll 4, the rotation speed SP2 of the wiper roll 6 or the back tension T2 exerted by the media roll 6 on the print medium 16 to limit (or compensate for) a decrease of the friction on the print medium 16 due to a reduction of the radius of the media roll 4 while the print medium 16 is being supplied.

Figure 5:
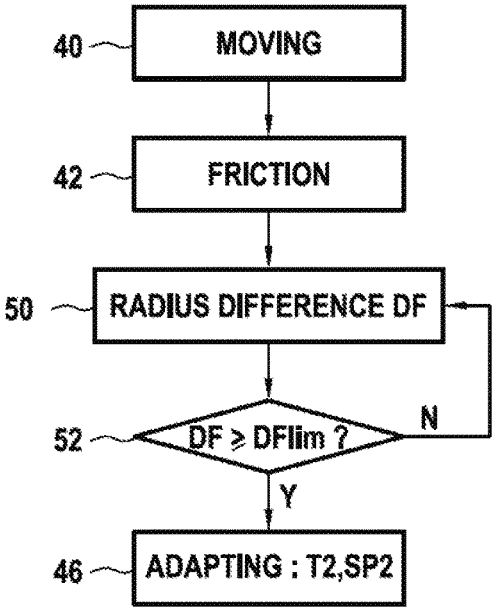
FIG. 5 illustrates a flow chart of an example of a method of the present disclosure.

FIG. 5 is a flow diagram showing a method according to a particular example of the present disclosure The device 30 depicted in FIG. 3 operates within the system 2 represented in FIGS. 1 and 2 to implement the method of FIG. 5.

It is assumed that the system 2 is in the initial (or reference) state illustrated in FIG. 1 and that the media roll 4 starts outputting the print medium 16 in the forward direction 26 under the driving action of the drive roll 8 as already explained.

The print medium 16 is moved (40) and friction is caused (42) by the wiper roll 6 as already explained earlier with reference to FIG. 4.

After a given time of moving (40) the medium print 16 forward while causing friction (42) thereon, the system 2 reaches the current state depicted in FIG. 2, as already explained with reference to FIG. 4. The device 30 then determines (50) the current radius r2 of the media roll 4 and calculates (50) the difference DF between the initial radius r1 of the media roll 4 (in the state shown in FIG. 1) and the current radius r2, that is: DF=r1−r2.

In 52, the device 30 detects whether the difference DF achieves a threshold value DFlim. In the positive case, the method proceeds to 46 to adapt the rotation speed SP2 of the wiper roll 6 or the back tension T2 exerted by the wiper roll 6 as already described with reference to FIG. 4.

If however it is detected in 52 that DF<DFlim, neither the rotation speed SP2 of the wiper roll 6 nor the back tension T2 exerted by the wiper roll is adapted. In that case, the device 30 may proceed again to 50 after a given time period.

The example implementation illustrated in FIG. 5 allows to limit the number of changes of the rotation speed SP of the wiper roll 6 and of the back tension T exerted by the media roll 4 on the print medium 16, thereby saving processing resources.

In a particular example, the device 30 performs periodically the adapting 46 as described above with reference to FIG. 4.

As indicated earlier, different techniques may be used by device 30 to determine the current radius of the media roll 4 in 44 (FIGS. 4 and 5).

In a particular example, the radius determining module MD2 may include (or be coupled to) an optical sensor to detect the radius of the media roll 4.

In a particular example, the radius determining module MD2 may estimate the current radius of the media roll 4 by determining the media roll turns versus the medium advance along the forward direction. Reference is made to document U.S. Pat. No. 9,114,949 B2 which describes a technique that may be used in the present disclosure to allow the device 30, illustrated in FIG. 3, to estimate the radius of a media roll. To do so, the radius determining module MD2 may be coupled to a rotation sensor which monitors a number of turns operated by (or an angular advancement of) the media roll 4, and coupled to an advancement sensor which detects a corresponding advancement operated by the print medium 16 in the forward direction as a result of the rotation of the media roll 4. In a particular example, the radius of the media roll is determined in 44 (FIGS. 4-5) based on a distance of advancement of the print medium 16 in the forward direction 26 from a first position (e.g., as shown FIG. 1) to a second position as shown FIG. 2) and based on an angle of rotation of the media roll 4 between the first and the second position.

What is claimed is:

1. A method including:

moving a print medium in a forward direction from a rotating media roll, from which the print medium is being output;

causing friction on the print medium using a rotating wiper roll contacting the surface of the print medium at a rotation speed;

determining a radius of the media roll; and adapting, based on the determined radius of the media roll, the rotation speed of the wiper roll or a back tension exerted by the media roll on the print medium so as to control the friction caused by the rotating wiper roll on the print medium.

2. The method of claim 1, including:

determining a radius difference between the determined radius of the media roll and a reference radius of the media roll; and detecting whether that the radius difference achieves a threshold value;

wherein said adapting is performed if the radius difference achieves the threshold value.

3. The container of claim 1, wherein said adapting is performed periodically.

4. The method of claim 1, wherein the radius of the media roll is determined based on a distance of advancement of the print medium in the forward direction from a first position to a second position and based on an angle of rotation of the media roll between the first and the second position.

5. The container of claim 1, wherein said adapting includes increasing the rotation speed of the wiper roll or the back tension exerted by the media roll.

6. The method of claim 1, wherein said adapting is performed so as to compensate for a decrease of a friction exerted by the wiper roll onto the print medium due to a decrease of the radius of the media roll from a reference radius to the determined radius.

7. The method of claim 1, wherein said adapting is performed so as to maintain constant a friction effect exerted by the wiper roll onto the print medium while the radius of the media roll decreases.

8. The method of claim 1, wherein said adapting includes setting the rotation speed and the back tension so as to satisfy the following conditions:

$$SP2=C\cdot SP1\cdot(WA1/WA1-A)); \quad (1)$$

$$T2=(1-C)\cdot T1\cdot(\cos(WA1-A/2)/\cos(WA1/2)); \quad (2)$$

and $$A=\sin^{-1}((r1-r2)/L); \quad (3)$$

wherein SP1 is a reference rotation speed of the wiper roll in a reference SP2 is the set rotation speed; WA1 is reference wrap angle defining the proportion of the wiper roll in contact with the print medium in the reference state; C is a weight comprised between 0 and 1; T2 is the set back tension; r1 is a reference radius of the media roll in the reference state; r2 is the determined radius of the media roll; and L is the distance between a rotation axis of the media roll and a rotation axis of the wiper roll, respectively.

9. The method of claim 8, wherein said adapting includes setting the rotation speed so that C=0.

10. The method of claim 8, wherein said adapting includes setting the back tension so that C=1.

11. The method of claim 1, wherein said determining the radius of the media roll and adapting the rotation speed of the wiper roll or a back tension exerted by the media roll on the print medium are repeated to maintain constant the friction effect exerted by the wiper roll onto the print medium.

12. A method including:

conveying a print medium in a forward direction from a rotating media roll;

applying wiper roll onto the print medium while the wiper roll is rotating at a rotation speed, to cause friction on the print medium; and adapting, based on the radius of the media roll, the rotation speed of the wiper roll or a back tension exerted by the media roll on the print medium to limit a decrease of the friction on the print medium due to a reduction of the radius of the media roll while the print medium is being supplied.

13. Device including:

a media roll to output, by rotation, a print medium in a forward direction to a printing area;

a wiper roll to contact the surface of the print medium at a rotation speed to cause, by rotating, friction on the print medium;

a radius determining module to determine a radius of the media roll outputting the print medium; and a setting module to adapt, based on the determined radius of the media roll, the rotation speed of the wiper roll or a back tension exerted by the media roll on the print medium so as to control the friction caused by the rotating wiper roll on the print medium.

14. The device of claim 13, wherein the wiper roll includes a foam to cause friction on the print medium.

* * * * *